United States Patent [19]

Watanabe et al.

[11] Patent Number: 4,526,671

[45] Date of Patent: Jul. 2, 1985

[54] SURFACE TREATMENT OF ALUMINUM OR ALUMINUM ALLOYS

[75] Inventors: Hiroshi Watanabe; Isao Shimamura, both of Hiratsuka; Masao Abe, Yokohama; Masashi Mizusawa, Fujisawa, all of Japan

[73] Assignee: Pilot Man-Nen-Hitsu Kabushiki Kaisha, Tokyo, Japan

[21] Appl. No.: 533,533

[22] Filed: Sep. 16, 1983

[30] Foreign Application Priority Data

Sep. 24, 1982 [JP] Japan ..... 57-167441
Jul. 15, 1983 [JP] Japan ..... 58-129143

[51] Int. Cl.[3] ..... C25D 11/06

[52] U.S. Cl. ..... 204/37.6; 204/38.3; 204/42

[58] Field of Search ..... 204/35 N, 35 R, 33, 204/38 A, 38 B, 42; 148/6.27

[56] References Cited

U.S. PATENT DOCUMENTS

| | | | |
|---|---|---|---|
| 3,669,856 | 6/1972 | Gedde | 204/58 |
| 3,849,263 | 11/1974 | Gedde | 204/35 N |
| 3,878,056 | 4/1975 | Yanagida et al. | 204/35 N |
| 3,929,593 | 12/1975 | Sugiyama | 204/38.3 |
| 3,929,594 | 12/1975 | Fromson | 204/38.3 |
| 4,021,592 | 5/1977 | Fromson | 204/38.3 |
| 4,042,471 | 8/1977 | Hasegawa et al. | 204/42 |
| 4,163,083 | 7/1979 | Pryor | 204/38.3 |
| 4,225,398 | 9/1980 | Hasegawa et al. | 204/38.3 |
| 4,242,417 | 12/1980 | Huang | 428/457 |

FOREIGN PATENT DOCUMENTS

| | | | |
|---|---|---|---|
| 655700 | 3/1974 | Fed. Rep. of Germany | 428/427 |
| 115989 | 9/1980 | Japan | 204/42 |
| 104687 | 6/1982 | Japan | 204/42 |
| 10000 | 1/1983 | Japan | 204/42 |

*Primary Examiner*—Howard S. Williams
*Assistant Examiner*—Terryence Chapman
*Attorney, Agent, or Firm*—Wenderoth, Lind & Ponack

[57] ABSTRACT

A white or grayish white substance can be formed by dipping, in the first step, aluminum or an aluminum alloy having an anodically oxidized film in a first solution containing a specific salt or electrolyzing with said first solution, thereby causing the product from this salt to enter into the micropore of said film and then, in the subsequent second step, dipping the product from the first step in a second solution containing a substance which reacts with the product from the salt to be converted into a white or grayish white compound or electrolyzing with said second solution.

18 Claims, No Drawings

SURFACE TREATMENT OF ALUMINUM OR ALUMINUM ALLOYS

BACKGROUND OF THE INVENTION

1. Field of the Invention

This invention relates to a surface treatment method, which comprises forming a white or grayish white substance in micropores of the anodically oxidized film of aluminum or aluminum alloy.

2. Description of the Prior Art

In the prior art, aluminum and aluminum alloys have been widely used as construction materials, nameplates, vehicles, decorative materials, etc., with coloration according to various materials. Their color tones have been, for example, metallic color tones in construction materials, giving cold impressions, such as amber color, gold color, and silver color. Therefore, aluminum and alluminum alloys in the field of construction materials which are of warm pastel color tone on a base of opaque white color or grayish white color have been desired.

For realizing a pastel color tone, it is necessary to obtain a base color of opaque white color or grayish white color, and for this purpose there have been proposed several methods of surface treatment for opaque whitening.

That is, examples of methods for forming opaque white anodically oxidized films are as follows.

(1) The method in which an aluminum material is subjected to whitening on its surface by alternating current electrolysis, direct-current electrolysis, or dipping (as disclosed in Japanese Patent Publications No. 28921/1965 and No. 1523/1966);

(2) The method in which an opaque white anodically oxidized film is obtained according to a primary electrolytic method (e.g., the Ematal method as disclosed in Japanese Patent Publications No. 28147/1979 and No. 28148/1979);

(3) The method, in which, after application of an anodically oxidized film, secondary electrolysis is carried out to obtain an opaque white anodically oxidized film (as disclosed in Japanese Patent Publications No. 14519/1960 and No. 11248/1979, and Japanese Laid-open Patent Application No. 37631/1975).

However, these methods involve the following problems. The chemical reagent employed is expensive or is a toxic substance, or its solution is unstable or requires a high bath voltage. Also, the extent of opaque whitening obtained is insufficient in practical application. Thus, under the present circumstances, coating methods are actually employed in place of these methods.

SUMMARY OF THE INVENTION

We have carried out research on the method for coloration of aluminum or aluminum alloys into a tone based on opaque white or grayish white and have found that, as a method for obtaining a basic opaque white or grayish white color, it is very effective to form a white or grayish white substance in the pores of an anodically oxidized film according to the method described below.

It has been found that a white or grayish white substance can be formed in a high concentration not found in the prior art in the pores of an anodically oxidized film of aluminum or an aluminum alloy by dipping, in the first step, aluminum or an aluminum alloy having an anodically oxidized film in a solution containing a specific salt such as a calcium salt or electrolyzing with said solution, thereby causing the product from this salt to enter into the micropores of the anodically oxidized film, and then, in the subsequent second step, dipping the product from the first step in a solution containing a substance which reacts with the product from the salt to be converted into a white or grayish white compound or carrying out electrolysis with the solution. The term "product from the salt" as used herein refers to a compound containing the metal of the salt, the metal per se or the salt per se and is used in this meaning in the present invention, including the Claims.

Thus, the present invention provides a method for surface treatment of aluminum or aluminum alloys, which comprises treating an aluminum or an aluminum alloy article having an anodically oxidized film according to the following two steps (1) and (2).

(1) a step of dipping the article in a first solution containing one or more salts selected from calcium salts, magnesium salts, barium salts, strontium salts, zinc salts, lead salts, titanium salts and aluminum salts or electrolyzing with the first solution; and (2) a subsequent step of dipping the article in a second solution containing one or more substances which react with the product from the above-mentioned salt in the micropores of the anodically oxidized film to be converted into a white or grayish white compound or electrolyzing with the second solution.

DETAILED DESCRIPTION OF THE INVENTION

By dipping, in the first step, aluminum or an aluminum alloy applied with an anodically oxidized film in a first solution containing one or more salts selected from calcium salts, magnesium salts, barium salts, strontium salts, zinc salts, lead salts, titanium salts, and aluminum salts or electrolyzing with the first solution, the product from the salt is caused to enter into the micropores of the anodically oxidized film. The electrolysis may be carried out according to direct-current electrolysis, alternating-current electrolysis, or electrolysis by a current with a waveform having the same effect as a direct-current or alternating-current.

A waveform having the same effect as a direct current or alternating current as herein mentioned is inclusive of AC-DC superimposing waves, DC or AC intermittent waves, PR waves, pulse waves, incomplete rectified waves, etc., including also waveforms which are combinations of these. Further included is a waveform of the so-called current restoration method, in which the voltage is changed in carrying out electrolysis with the above waveforms.

In the subsequent second step, the treated product from the first step is dipped in a second solution containing one or more substances which react with the product from the salt to be converted into a white or grayish white compound, or electrolysis is carried out with the second solution. The substance which reacts with the product from the salt to be converted to a white or grayish white compound has, as its principal ingredient, a substance as set forth below, for example.

First, examples of inorganic substances are: inorganic acids such as sulfuric acid, phosphoric acid, nitric acid, hydrochloric acid, hydrofluoric acid, and sulfamic acid; alkali salts and ammonium salts of the above inorganic acids such as sodium phosphate, sodium fluoride, and ammonium fluoride; alkali hydroxides such as sodium hydroxide and potassium hydroxide; alkali carbonates such as sodium carbonate and potassium carbonate;

alkalis having an acid group such as sodium metasilicate, sodium orthosilicate, trisodium phosphate, sodium stannate, potassium stannate, sodium metaborate, and sodium pyrolate; and ammonia water.

Examples of organic substances are: aliphatic acids such as oxalic acid and acetic acid; salts of such aliphatic acids such as ammonium oxalate; amines such as monoethanol amine, diethanol amine, and triethanol amine; aliphatic sulfonic acids such as ethylsulfonic acid; aromatic acids such as benzoic acid; aromatic sulfonic acids such as cresol sulfonic acid, phenol sulfonic acid, toluene sulfonic acid, and sulfosalycilic acid. In the case of organic substances, some of the derivatives and substituted compounds of substances as enumerated above may have similar actions.

By dipping the product in a second solution containing one or more of these substances or carrying out electrolysis with this solution, these substances are caused to react with the product from the salt introduced into the micropores by the electrolysis in the first step to form a white or grayish compound in the micropores. If necessary, this step is followed by a posttreatment such as conventional pore sealing or drying. The waveform in the electrolysis to be applied in this case can be the same as in the first step.

Examples of the calcium salt to be used in the electrolysis in the first step are calcium nitrate, calcium chloride, calcium acetate, calcium bromide, and calcium iodide. Examples of barium salts are barium nitrate, barium chloride, barium acetate, barium bromide, and barium iodide. Magnesium salts may be, for example, magnesium nitrate, magnesium chloride, magnesium acetate, magnesium bromide, magnesium iodide, and magnesium sulfate. Strontium salts may include, for example, strontium nitrate, strontium chloride, strontium acetate, strontium bromide, and strontium iodide. As zinc salts, there are, for example, zinc sulfate, zinc nitrate, zinc chloride, zinc acetate, zinc bromide, and zinc iodide. Typical examples of lead salts are lead nitrate, lead chloride, and lead acetate. Suitable aluminum salts are, for example, aluminum sulfate, sodium aluminate, aluminum phosphate, aluminum chloride, and aluminum oxalate. Examples of titanium salts are titanium sulfate and titanium potassium oxalate.

In the first step, the aforsaid salt is contained in a concentration of about 1 g/liter to saturation, preferably about 10 to 50 g/liter. The conditions of dipping in this solution are 20° to 80° C., preferably 40° to 65° C., for the liquid temperature, and about 1 to 50 minutes, preferably about 10 to 30 minutes, for the dipping time.

The electrolysis conditions in this first solution, in the case of direct-current electrolysis, with the use of aluminum or an aluminum alloy as the cathode, are about 5 to 50 V, preferably about 10 to 25 V, for the voltage, about 10° to 50° C., preferably about 15° to 30° C., for the liquid temperature, and about 30 seconds to 30 minutes, preferably about 3 to 10 minutes, for the time. In the case of alternating-current electrolysis, the voltage, the liquid temperature and the time are the same as in direct-current electrolysis.

On the other hand, the second solution containing the aforesaid substance used in the second step contains the substance in a concentration of about 0.5 g/liter to 200 g/liter, preferably about 1 to 50 g/liter. The dipping conditions in this solution are 10° to 80° C., preferably 30° to 60° C., for the liquid temperature, and about 30 seconds to 50 minutes, preferably about 10 to 30 minutes, for the dipping time.

The electrolysis conditions in this second solution, in case of direct-current electrolysis, with the use of aluminum or an aluminum alloy as the cathode, are about 5 to 40 V, preferably about 10 to 30 V, for the voltage, about 10° to 40° C., preferably about 20° to 30° C., for the liquid temperature, and about 30 seconds to 20 minutes, preferably about 3 to 10 minutes, for the time. In the case of alternating-current electrolysis, the voltage, the liquid temperature and the time are the same as in direct-current electrolysis.

Thus, according to the present invention, a white or grayish white product can be obtained in the pores of the film, and the density of the product is shown as the white color density of the anodically oxidized film finally obtained in Table 1, as compared with those of the prior art.

TABLE 1

| Sample | White Color Density |
|---|---|
| White film of invention | Very good |
| White coating, white porcelain | Very good |
| White film of the prior art | Slightly inferior |
| Silver-finished anodically oxidized film (silver aluminum sash), aluminum coin of 1 yen | Not white (metallic color) |

Further, as another advantage of the present invention, the liquid conditions (liquid composition, pH, temperature, etc.) and the electrolytic conditions (current, voltage, waveform, etc.) in the first step can be chosen from wide ranges because the form of the aforesaid substance in the micropores is not restricted to a narrow range, and the substance is only required to be introduced more deeply and in greater quantity into the micropores. Also, the liquid conditions, the treatment conditions (electrolytic conditions, dipping conditions) in the second step can be chosen from very wide ranges because it is only basically required that the chemical, electrochemical reaction between the aforesaid substance in the micropores and the liquid component can be carried out sufficiently to form a white or grayish white insoluble compound. Of course, there are suitable combinations of the first step and the second step, which are so many in number for the wide ranges of choice and cannot be enumerated here but can be determined easily by those skilled in the art by routine experimentation.

Furthermore, it is also possible to add to each solution in the first step and the second step various additives such as a pH buffering agent, surfactant, reaction accelerator, and reaction inhibitor, whereby the efficiency of formation of the white color or grayish white substance as well as various properties such as the stability of the solution can be improved.

Still another salient feature to be noted in the present invention is that a pastel tone coloration with a base tone of opaque white or grayish white can be obtained by combination with various aluminum coloration methods already known in the art. Examples of the combinations of the step for coloration in the present invention and the aluminum coloration methods which can be adopted are listed in Table 2.

A: Aluminum alloy self-coloring method (Japanese Patent Publication No. 16341/1974 and others)

B: Electrolytic self-coloring method (Kalcolor method and others)

C: Electrolytic coloring method, Multi-step electrolytic coloring method (Japanese Patent Publication Nos. 1715/1963 and 67043/1974, and others)

D: Inorganic or organic dip coloring, inorganic alternate dip coloring method

E: Coating method (electrodeposition method)

TABLE 2

| Steps for Coloration | Adoptable Coloration Methods |
|---|---|
| Simultaneous with the anodic oxidation treatment | A, B |
| Between the anodic oxidation treatment and the electrolytic treatment in the first step | C, D |
| Between the electrolytic treatment in the first step and the treatment in the second step | C, D |
| Simultaneous with the treatment in the second step | C, D |
| After the treatment in the second step | C, D, E |

As shown in Table 2, the present invention can be combined with many coloration methods, whereby the provision of colored materials of aluminum or an aluminum alloy adapted for the requirements in the market, colored in pastel color tone with warm tinctures based on opaque white or grayish white color, such as cream color, beige color, ivory color, and cherry color can be realized. Realization of a color tone with warm tincture of pastel tone according to such combinations of various coloration methods of aluminum or an aluminum alloy with the present invention can be made practically possible with ease according to the present invention. Accordingly, it can be stated here that the present invention is basically applicable or utilizable for all of these combination methods, irrespective of the difference in the steps or stages of such combinations.

The present invention is further illustrated by the following Examples. In all of these Examples, preparations of opaque colored films by application of the present invention are illustrated, but the descriptions are made primarily of the portion concerning the present invention, and description of conventional pre-treatments or post-treatments are omitted.

The aluminum plate of JIS (Japanese Industrial Standard) A 1100P, the extruded aluminum material of JIS A 6063 and the aluminum plate of JIS A 5052 used in these Examples have compositions or purities as shown below.

| JIS A 1100P | |
|---|---|
| Al | 99% or more |
| Si + Fe | 0.1% or less |
| Zn | 0.1% |
| Cu | 0.05–0.2% |
| Mn | 0.05% or less |

| JIS A 6063 | | JIS A 5052 | |
|---|---|---|---|
| Mg | 0.45–0.9% | Cu | 0.1% |
| Fe | 0.35% or less | Si | 0.45% |
| Cu | 0.1% or less | Fe | 0.45% |
| Si | 0.2–0.6% | Mn | 0.1% |
| Mn | 0.1% or less | Mg | 2.2–2.8% |
| Zn | 0.1% or less | Zn | 0.1% |
| Cr | 0.1% or less | Cr | 0.15–0.35% |
| Al | remainder | Al | remainder |

EXAMPLE 1

An aluminum plate of JIS A 1100P was subjected to the pre-treatments of defatting, etching and smut removal, and then coated with an anodically oxidized film by direct-current electrolysis in an aqueous 15% sulfuric acid solution with a current density of 1.5 A/dm$^2$ for 30 minutes, which was followed by electrolysis in an aqueous 30 g/liter solution of calcium acetate (30° C.) with an alternating-current voltage of 20 V for 10 minutes. After washing the plate with water, electrolysis was carried out in an aqueous 30 g/liter solution of phosphoric acid (30° C.) with an alternating-current voltage of 20 V for 10 minutes to obtain an opaque white film on the surface of the aluminum plate.

EXAMPLE 2

The same treatment as in Example 1 was applied to the extruded aluminum material of JIS A 6063, and then electrolysis was carried out with an aqueous 10 g/liter solution of barium acetate (30° C.) with a direct-current voltage of 15 V for 2 minutes. After washing the material with water, electrolysis was carried out with an aqueous 10 g/liter solution of sulfuric acid (30° C.) with an alternating-current voltage of 20 V for 20 minutes to obtain an opaque white film on the surface of the extruded aluminum material.

EXAMPLE 3

The same treatment as in Example 1 was applied to the aluminum plate of JIS A 1100P, and then electrolysis was carried out with an aqueous 10 g/liter solution of zinc sulfate (25° C.) with an alternating-current voltage of 20 V for 5 minutes. After washing the plate with water, electrolysis was carried out with an aqueous 20 g/liter solution of oxalic acid (30° C.) with a direct-current voltage of 15 V for 20 minutes to obtain an opaque grayish white film on the surface of the aluminum plate.

EXAMPLE 4

The same treatment as in Example 1 was applied to the aluminum plate of JIS A 1100P, and then electrolysis was carried out with an aqueous 10 g/liter solution of lead acetate (25° C.) with a direct-current voltage of 15 V for 2 minutes. After washing the plate with water, the treated product was dipped in an aqueous 10 g/liter solution of ammonium fluoride (40° C.) for 20 minutes to obtain an opaque grayish white film on the surface of the aluminum plate.

EXAMPLE 5

The same treatment as in Example 1 was applied to the aluminum plate of JIS A 1100P, and then electrolysis was carried out with an aqueous 10 g/liter solution of barium chloride (30° C.) with an alternating-current voltage of 20 V for 5 minutes. After washing the plate with water, electrolysis was carried out with an aqueous 30 g/liter solution of ammonium oxalate (25° C.) with a direct-current voltage of 15 V for 15 minutes to obtain an opaque white film on the surface of the aluminum plate.

EXAMPLE 6

The same treatment as in Example 1 was applied to the aluminum plate of JIS A 1100P, then electrolysis was carried out with an aqueous 10 g/liter solution of strontium iodide (25° C.) with a direct-current voltage of 15 V for 2 minutes. After washing the plate with water, the treated product was dipped in an aqueous 30 g/liter solution of trisodium phosphate at 40° C. for 20 minutes to obtain an opaque white film on the surface of the aluminum plate.

EXAMPLE 7

The same treatment as in Example 1 was applied to the aluminum plate of JIS A 1100P, and then electrolysis was carried out with an aqueous 30 g/liter solution of magnesium nitrate (30° C.) with an alternating-current voltage of 20 V for 5 minutes. After washing the plate with water, the treated product was dipped in an aqueous 30 g/liter solution of sodium carbonate (40° C.) for 20 minutes to obtain an opaque white film on the surface of the aluminum plate.

EXAMPLE 8

An anodically oxidized film was formed on an aluminum plate of JIS A 1100P in the same manner as in Example 1, and electrolysis was carried out with a colored liquid containing 4 g/liter of stannous sulfate and 15 g/liter of sulfuric acid (25° C.) with an alternating-current voltage of 15 V for 3 minutes to impart an olive color to the plate. After washing the plate with water, electrolysis was carried out with an aqueous 10 g/liter solution of calcium acetate (30° C.) with an alternating-current voltage of 20 V for 5 minutes. After washing the plate with water, the treated product was dipped in an aqueous 10 g/liter solution of trisodium phosphate (40° C.) for 20 minutes to obtain an opaque beige film on the surface of the aluminum plate.

EXAMPLE 9

An anodically oxidized film was formed on an aluminum plate of JIS A 1100P in the same manner as in Example 1, and electrolysis was carried out with an aqueous solution of 5 g/liter of sodium selenite and 15 g/liter of sulfuric acid (25° C.) with an alternating-current voltage of 15 V for 3 minutes to impart a gold color to the plate. After washing the plate with water, electrolysis was carried out with an aqueous 10 g/liter solution of magnesium sulfate (30° C.) with an alternating-current voltage of 20 V for 5 minutes. After washing the plate with water, the treated product was dipped in an aqueous 10 g/liter solution of phosphoric acid (40° C.) for 20 minutes to obtain an opaque cream film on the surface of the aluminum plate.

EXAMPLE 10

An anodically oxidized film was formed on an aluminum plate of JIS A 1100P in the same manner as in Example 1, and the plate was dipped in a dye bath containing 2.5 g/liter of Almalite Gold 108 (dye produced by Kaname Shokai, Japan) (50° C.) for 5 minutes to impart a gold color to the plate. After washing the plate with water, electrolysis was carried out with an aqueous 10 g/liter solution of aluminum sulfate (30° C.) with an alternating-current voltage of 20 V for 5 minutes. After washing the plate with water, the treated product was dipped in an aqueous 30 g/liter solution of sodium carbonate (40° C.) for 20 minutes to obtain an opaque cream film on the surface of the aluminum plate.

EXAMPLE 11

An aluminum plate of JIS A 1100P was subjected to the pre-treatments of defatting, etching and smut removal, and then an anodically oxidized film self-colored with a pale bronze color was formed by direct-current electrolysis in an aqueous solution of 100 g/liter of sulfosalycilic acid and 0.5 g/liter of sulfuric acid (20° C.) with a current density of 3 A/dm$^2$ for 30 minutes, which was followed by electrolysis in an aqueous 10 g/liter solution of titanium sulfate (30° C.) with an alternating-current voltage of 20 V for 5 minutes. After washing with water, the product was dipped in an aqueous 20 g/liter solution of phosphoric acid (40° C.) to obtain an opaque beige film on the surface of the aluminum plate.

EXAMPLE 12

The opaque white film obtained in Example 7 was subjected to pore sealing with an aqueous solution containing 3 g/liter or more of nickel acetate at 95° C. or higher temperature to obtain a film colored in opaque, pale green color.

EXAMPLE 13

An aluminum plate of JIS A 5052 was coated with a yellow anodically oxidized film similarly as in Example 1 and thereafter electrolysis was carried out with an aqueous 10 g/liter solution of calcium acetate (30° C.) with an alternating-current voltage of 20 V for 5 minutes. After washing the water, the treated plate was dipped in aqueous 30 g/liter solution of sodium carbonate (40° C.) for 20 minutes to obtain an opaque cream film on the surface of the aluminum plate.

EXAMPLE 14

The opaque white film obtained in Example 1 was washed with water and with hot water, and then subjected to electrophoretic coating treatment with an electrodeposition paint "Honeylite" containing acrylmelamine as the main component produced by Honey Kasei Co., Japan, at a liquid temperature of 22° C. with a direct-current voltage of 170 V for 3 minutes, which was followed by baking treatment, to obtain an opaque white composite film.

EXAMPLE 15

The opaque white film obtained in Example 1 was washed with water, and electrolysis was carried out with a solution containing 15 g/liter of sulfuric acid and 5 g/liter of sodium selenite (25° C.) with an alternating-current voltage of 15 V for one minute, to obtain an opaque cream film on the surface of the aluminum plate.

EXAMPLE 16

An anodically oxidized film was formed on an aluminum plate of JIS A 1100P in the same manner as in Example 1, and electrolysis was carried out with an aqueous 20 g/liter solution of calcium sulfate (30° C.) with an alternating-current voltage of 20 V for 5 minutes. After washing with water, electrolysis was carried out with an aqueous solution containing 15 g/liter of sulfuric acid and 5 g/liter of sodium selenite (25° C.) with an alternating-current voltage of 15 V for 1 minute. After washing with water, the treated product was dipped in an aqueous 20 g/liter solution of phosphoric acid (40° C.) for 15 minutes to obtain an opaque, white film on the surface of the aluminum plate.

EXAMPLE 17

An anodically oxidized film was formed on an aluminum plate of JIS A 1100P in the same manner as in Example 1, and electrolysis was carried out with an aqueous 10 g/liter solution of calcium acetate (25° C.) with a direct-current voltage of 15 V for 1 minute. After washing with water, the product was dipped in an aqueous 10 g/liter of ferric ammonium oxalate (50° C.) for 10 minutes. After washing with water, the treated product was dipped in an aqueous 30 g/liter solution of sodium carbonate (40° C.) for 15 minutes to obtain an opaque pale yellow film on the surface of the aluminum plate.

EXAMPLE 18

An anodically oxidized film was formed on an aluminum plate of JIS A 1100P in the same manner as in Example 1, and electrolysis was carried out with an aqueous 20 g/liter solution of calcium acetate (30° C.) with a direct-current voltage of 15 V for 1 minute. After washing with water, electrolysis was carried out with an aqueous solution of 5 g/liter of sodium selenite and 15 g/liter of sulfuric acid (30° C.) with an alternating-current voltage of 18 V for 20 minutes to obtain an opaque pale cream film on the surface of the aluminum plate.

EXAMPLE 19

An aluminum plate of JIS A 1100P was subjected to the pre-treatments of defatting, etching and smut removal, and then coated with an anodically oxidized film by direct-current electrolysis in an aqueous 15% sulfuric acid solution (60° C.) with a current density of 1.5 A/dm$^2$ for 30 minutes, which was followed by dipping in an aqueous 50 g/liter solution of aluminum sulfate (60° C.) for 20 minutes. After washing with water, the treated product was dipped in an aqueous 20 g/liter solution of phosphoric acid (40° C.) for 20 minutes to obtain an opaque white film on the surface of the aluminum plate.

EXAMPLE 20

The same treatment as in Example 1 was applied to an extruded aluminum material of JIS A 6063, and then the plate was dipped in an aqueous 20 g/liter solution of calcium acetate (60° C.). After washing with water, electrolysis was carried out with an aqueous 30 g/liter solution of sulfuric acid (35° C.) with an alternating-current voltage of 20 V for 20 minutes to obtain an opaque white film on the surface of the extruded aluminum material.

EXAMPLE 21

The same treatment as in Example 1 was applied to an aluminum plate of JIS A 1100P, and then electrolysis was carried out with a aqueous solution containing 5 g/liter of sodium selenite and 15 g/liter of sulfuric acid (30° C.) with an alternating-current voltage of 15 V for 1 minute to color the plate with a gold color. After washing with water, the colored plate was dipped in an aqueous 30 g/liter solution of magnesium sulfate (60° C.) for 20 minutes. After washing with water, electrolysis was carried out with an aqueous 30 g/liter solution of phosphoric acid (30° C.) with an alternating-current voltage of 20 V for 20 minutes to obtain an opaque cream film on the surface of the aluminum plate.

EXAMPLE 22

After an extruded aluminum material of JIS A 6063 was subjected to the pre-treatments of defatting, etching and smut removal, direct-current electrolysis was conducted with an aqueous solution containing 100 g/liter of sulfosalicylic acid and 0.5 g/liter of sulfuric acid (20° C.) with a current density of 3 A/dm$^2$ for 30 minutes to form an anodically oxidized film self-colored with a pale bronze color, which was followed by dipping in an aqueous 10 g/liter solution of barium acetate (50° C.) for 20 minutes. After washing with water, the treated product was subjected to electrolysis with an aqueous 30 g/liter solution of ammonium oxalate with a direct-current voltage of 15 V for 5 minutes to obtain an opaque beige film on the surface of the extruded aluminum material.

EXAMPLE 23

The opaque white film obtained in Example 20 was dipped in a dye bath containing 2.5 g/liter of Almalite Gold 108 (a dye produced by Kaname Shokai) (50° C.) for 5 minutes, to obtain an opaque cream film on the surface of the extruded aluminum material.

As described above, the colored film of the present invention obtained in each example can be improved in durability by a pore sealing treatment or any of various clear coatings by electrodeposition, electrostatic coating, dipping, spraying, etc. conventionally practiced.

What is claimed is:

1. A method for the surface treatment of aluminum or aluminum alloys, which comprises treating aluminum or an aluminum alloy having an anodically oxidized film on the surface thereof according to the steps of:

(1) electrolyzing the anodized aluminum or aluminum alloy in a first solution containing at least one salt selected from calcium salts, magnesium salts, barium salts, strontium salts, zinc salts, lead salts, titanium salts and aluminum salts so as to cause the salts to permeate into the micropores of the anodized film and form a product therein; and (2) subsequently dipping the thus-treated anodized aluminum or aluminum alloy into a second solution containing one or more substances which react with the product from said salt formed in the micropores of the anodically oxidized film as a result of said electrolysis in step (1), to convert the thus-formed product into a white or grayish white compound or electrolyzing the thus-treated aluminum or aluminum alloy with said second solution to produce said white or grayish white compound as in the dipping step.

2. A method according to claim 1 wherein said electrolysis in either step (1) or (2) is carried out according to any one of direct-current electrolysis, alternating-current electrolysis or electrolysis with a current of a waveform having an effect equal to direct current or alternating current.

3. A method according to claim 1 wherein the substance which reacts with the product form said salt to be converted into a white or grayish white compound is at least one number selected from the group consisting of inorganic acids, alkali or ammonium salts of inorganic acids, alkali hydroxides, alkali carbonates, aliphatic acids, salts of aliphatic acids, aromatic acids, salts of aromatic acids, aromatic sulphonic acids and derivatives and substituted products thereof.

4. A method according to claim 1 wherein at least one coloration treatment selected from an alloy self-coloring treatment, an electrolysis self-coloring treatment, an electrolysis coloring treatment, a dip coloring treatment and a coating treatment is conducted at any desired stage of said method.

5. A method according to claim 1 in which the salt in the first solution is selected from the group consisting of calcium nitrate, calcium chloride, calcium acetate, calcium bromide, calcium iodide, barium nitrate, barium chloride, barium acetate, barium bromide, barium iodide, magnesium nitrate, magnesium chloride, magnesium acetate, magnesium bromide, magnesium iodide, magnesium sulfate, strontium nitrate, strontium chloride, strontium acetate, strontium bromide, strongtium iodide, zinc sulfate, zinc nitrate, zinc chloride, zinc acetate, zinc bromide, zinc iodide, lead nitrate, lead chloride, lead acetate, aluminum sulfate, sodium aluminate, aluminum phosphate, aluminum chloride, aluminum oxalate, titanium sulfate and titanium potassium oxalate, and wherein the substance which reacts with the product of the salt is selected from the group consisting of sulfuric acid, phosphoric acid, nitric acid, hydrochloric acid, hydrofluoric acid, sulfamic acid, sodium phosphate, sodium fluoride, ammonium fluoride, sodium hydroxide, potassium hydroxide, sodium carbonate, potassium carbonate, sodium metasilicate, sodium orthosilicate, trisodium phosphate, sodium stannate, potassium stannate, sodium metaborate, sodium pyrolate, ammonia water, oxalic acid, acetic acid, ammonium oxalate, monoethanol amine, diethanol amine, triethanol amine, ethylsulfonic acid, benzoic acid, cresol sulfonic acid, phenol sulfonic acid, toluene sulfonic acid, and sulfosalycilic acid.

6. A method according to claim 1 or 5 wherein the salt is present in the solution from about 1 g/liter to saturation.

7. A method according to claim 6 wherein the salt is present in an amount of about 10 to 50 g/liter.

8. A method according to claim 6 in which the electrolysis in step (1) is carried out with the aluminum or aluminum alloy as the cathode at a voltage of about 5 to 50 V, a temperature of about 10° to 50° C. and for a time period ranging from about 30 seconds to 30 minutes.

9. A method according to claim 8 in which step (2) is carried out by dipping the thus-treated anodized aluminum or aluminum alloy in said second solution containing said substance in a concentration of 0.5 g/liter to 200 g/liter at a temperature of about 10° to 80° C. for a time period ranging from about 30 seconds to 50 minutes.

10. A method according to claim 8 in which step (2) is carried out by electrolysis in said second solution containing said substance in a concentration of about 0.5 g/liter to 200 g/liter at a voltage of 5 to 40 V at a temperature of about 10° to 40° C. for about 30 seconds to 50 minutes.

11. A method for the surface treatment of aluminum or aluminum alloys, which comprises treating aluminum or an aluminum alloy having a anodically oxidized film on the surface thereof according to the steps of:

(1) dipping the anodized aluminum or aluminum alloy in a first solution containing at least one salt selected from calcium salts, magnesium salts, barium salts, strontiun salts, zinc salts, lead salts, titanium salts and aluminum salts so as to cause the salts to premeate into the micropores of the anodized film; and (2) subsequently electrolyzing the thus-treated anodized aluminum or aluminum alloy with a second solution containing one or more substances which react with the product from said salt formed in the micropores of the anodically oxidized film as a result of the dipping in step (1), to convert the thus-formed product into a white or grayish white compound.

12. A method according to claim 11 wherein said electrolysis in step (2) is carried out according to any one of direct-current electrolysis, alternating-current electrolysis or electrolysis with a current of a waveform having an effect equal to direct current or alternating current.

13. A method according to claim 11 wherein the substance which reacts with the product from said salt to be converted into a white or grayish white compound is at least one member selected from the group consisting of inorganic acids, alkali or ammonium salts of inorganic acids, alkali hydroxides, alkali carbonates, aliphatic acids, salts of aliphatic acids, aromatic acids, salts of aromatic acids, aromatic sulphonic acids and derivatives, and substituted products thereof.

14. A method according to claim 11 wherein at least one coloration treatment selected from an alloy self-coloring treatment, an electrolysis self-coloring treatment, an electrolysis coloring treatment, a dip coloring treatment and a coating treatment is conducted at any desired stage of said method.

15. A method according to claim 11 in which the salt in the first solution is selected from the group consisting of calcium nitrate, calcium chloride, calcium acetate, calcium bromide, calcium iodide, barium nitrate, barium chloride, barium acetate, barium bromide, barium iodide, magnesium nitrate, magnesium chloride, magnesium acetate, magnesium bromide, magnesium iodide, magnesium sulfate, strontium nitrate, strontium chloride, strontium acetate, strontium bromide, strongtium iodide, zinc sulfate, zinc nitrate, zinc chloride, zinc acetate, zinc bromide, zinc iodide, lead nitrate, lead chloride, lead acetate, aluminum sulfate, sodium aluminate, aluminum phosphate, aluminum chloride, aluminum oxalate, titanium sulfate and titanium potassium oxalate, and wherein the substance which reacts with the product of the salt is selected from the group consisting of sulfuric acid, phosphoric acid, nitric acid, hydrochloric acid, hydrofluoric acid, sulfamic acid, sodium phosphate, sodium fluoride, ammonium fluoride, sodium hydroxide, potassium hydroxide, sodium carbonate, potassium carbonate, sodium metasilicate, sodium orthosilicate, trisodium phosphate, sodium stannate, potassium stannate, sodium metaborate, sodium pyrolate, ammonia water, oxalic acid, acetic acid, ammonium oxalate, monoethanol amine, diethanol amine, triethanol amine, ethylsulfonic acid, benzoic acid, cresol sulfonic acid, phenol sulfonic acid, toluene sulfonic acid, and sulfosalycilic acid.

16. A method according to claim 11 or 15 in which step (1) is carried out by dipping the anodized aluminum or aluminum alloy in said first solution containing a salt in a concentration of 1 g/liter to saturation at a temperature of about 20° to 80° C. for about 1 to 15 minutes and step (2) is carried out by electrolysis in said second solution containing said substance in a concentration of about 0.5 g/liter to 200 g/liter at a voltage of 5 to 40 V and at a temperature of about 10° to 40° C. for about 30 seconds to 50 minutes.

17. A method according to claim 11 or 15 wherein the salt is present in the solution from about 1 g/liter to saturation.

18. A method according to claim 17 wherein the salt is present in an amount of about 10 to 50 g/liter.

* * * * *